United States Patent [19]

Jackson

[11] 4,377,123

[45] Mar. 22, 1983

[54] BOAT STABILIZER APPARATUS

[76] Inventor: Lester L. Jackson, 1484 S. Main, Salt Lake City, Utah 84115

[21] Appl. No.: 185,346

[22] Filed: Sep. 8, 1980

[51] Int. Cl.[3] ..... B63B 21/48

[52] U.S. Cl. ..... 114/126; 114/311

[58] Field of Search ..... 114/126, 145 R, 170, 114/127, 128, 134, 140, 162, 311

[56] References Cited

U.S. PATENT DOCUMENTS

| | | | |
|---|---|---|---|
| 1,064,473 | 6/1913 | Haas | 114/145 R |
| 2,911,934 | 11/1959 | Harris | 114/126 |
| 3,626,887 | 12/1971 | Schutt | 114/145 R |
| 4,077,077 | 3/1978 | Harper | 114/140 |

FOREIGN PATENT DOCUMENTS

| | | | |
|---|---|---|---|
| 51922 | 9/1920 | Sweden | 114/145 R |

*Primary Examiner*—Sherman D. Basinger
*Attorney, Agent, or Firm*—K. S. Cornaby

[57] ABSTRACT

A boat stabilizer apparatus comprising as an integral unit a stabilizer fin, a fin support strut to maintain the upright position of the stabilizer fin, moveable baffles attached to the fin to counterbalance laterally moving water, and an elongated shaft for attaching the stabilizer to the boat. The stabilizer reduces rolling or heeling, aids in controlling the boat, and serves to prevent the boat from being blown off course.

4 Claims, 5 Drawing Figures

BOAT STABILIZER APPARATUS

BACKGROUND OF THE INVENTION

The present invention relates to a boat stabilizer adapted for use in conjunction with small boats to increase control and to reduce side roll or heeling.

A significant number of boating fatalities each year are caused by boats overturning when they are caught in an unexpected storm or sideswiped by the wake of a large boat passing by. Heeling also contributes to passenger discomfort and reduces the speed and efficiency of the boat. The present invention is designed to prevent or significantly reduce such heeling about the boat's longitudinal axis and thus decrease the probability of capsizing, increase the control of the boat, and aid in passenger comfort.

Attempts have been made to overcome the problem of heeling by use of ballast. This causes the boat to ride lower in the water, thereby increasing water resistance and requiring extra power to propel the boat. Other approaches have been to provide for two or more hulls or the use of outriggers. Although such arrangements provide considerable resistance to heeling, these hulls are fragile and unstable in rough water. Accordingly, such designs have enjoyed only limited application.

Other attempts have been made to increase control and deter lateral drift in boats through the use of stabilizers, fins, and other trolling devices, such as those disclosed in U.S. Pat. Nos. 1,596,009; 2,858,788; 3,505,968; 3,626,887; 3,633,531; 2,654,336; 3,823,684; and 3,990,384. While several of these patents show stabilizer fins or trolling boards to control boat motion, none has proved effective in holding a boat on course in rough or moving water.

OBJECT OF THE INVENTION

It is a primary purpose of the present invention to provide a stabilizer assembly of design and construction which will prevent rolling or heeling of small boats without reducing the efficiency of the boat.

Another object of the invention is to prevent hull damage by deflecting floating objects or by stopping the boat if an underwater obstruction is encountered.

An additional object is to assist in controlling the boat by acting as a pivot for turning and to allow docking in crosswinds without being blown against the dock.

Still a further object of the invention is to provide a stabilizer which prevents a boat from being blown off course and for trolling into heavy winds at slow trolling speeds, or trolling downwind without power and remaining on course.

SUMMARY OF THE INVENTION

The present invention relates to a boat stabilizer apparatus which comprises a stabilizer fin mounted along its leading edge to the lower portion of an elongated shaft. Located on mutually opposite sides of the stabilizer fin are a pair of hinged flaps or baffles which can extend laterally outwardly from the side surfaces of the fin when in use. Flap stops are disposed on the outer surface of each baffle to limit the extent to which the baffles may open. The upper portion of the elongated shaft is mounted to the boat by appropriate means to permit raising and lowering of the apparatus. In a preferred embodiment, a support strut extends upwardly from the rear of the fin when the fin is disposed at the front of the boat to rest against the hull of the boat to secure the fin in a substantially vertical position and in alignment with the longitudinal axis of the boat. The flaps open from their rest position adjacent the fin sides when loss of power or strong wind moves the boat rearwardly. The open flaps maintain the boat pointed into the wind and function as sea anchors. In an alternative embodiment, the apparatus is attached at a position other than on the bow of the boat, such as along the keel extending downwardly from within the hull of the boat.

Further objects and features of the invention will become apparent from the following detailed description, taken together with the accompanying drawings.

THE DRAWINGS

The preferred mode for carrying out the invention is illustrated in the accompanying drawings, in which:

FIG. 1 is a perspective view of one embodiment of the apparatus installed at the bow of a boat;

FIG. 2, an enlarged top plan view of the stabilizer fin and shaft with the baffles in the open position;

FIG. 3, a side elevational view of the embodiment of FIG. 1, showing the apparatus in a raised position;

FIG. 4, a side elevational view of an alternate embodiment of the apparatus installed within the full of the boat; and FIG. 5, a top plan view of the stabilizer fin taken along line 5—5 of FIG. 4.

DETAILED DESCRIPTION OF THE PREFERRED EMBODIMENTS

Figure 1:
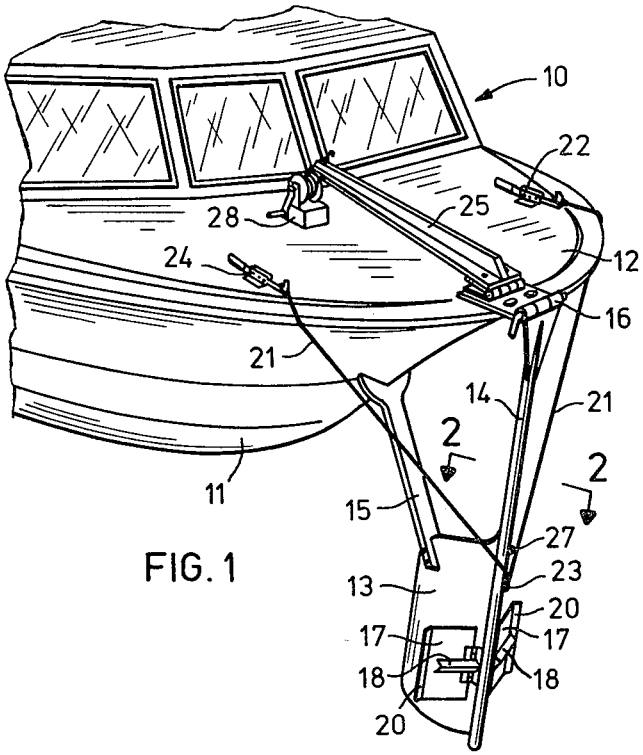

As shown in the attached drawings, FIG. 1 illustrates a conventional motor boat 10 having a hull 11 and a bow 12. Adapted for attachment to bow 12 is a flat, substantially planar stabilizer fin 13 formed of a rigid material, such as aluminum, fiberglass, or the like. Stabilizer fin 13 is secured in a fixed relationship to an elongate shaft 14 preferably below the bottom of boat 10. A fin support strut 15 is fixedly secured preferably to the trailing edge of fin 13, and extends upwardly at an angle from the trailing edge of stabilizer fin 13 and seats against hull 11.

Figure 2:
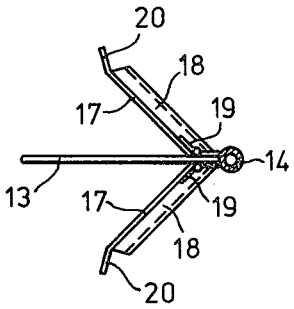

Of particular importance are a pair of baffles or flaps 17 which are disposed respectively on opposite lateral sides of fin 13 and are hingedly attached to the leading edge of fin 13 so that flaps 17 extend rearwardly along the sides of fin 13 from their point of attachment with fin 13. Flaps or baffles 17 are adapted to open or extend outwardly from the sides of fin 13 by rotating outwardly from a pair of hinges 19 a predetermined distance. A pair of baffle stops 18 disposed respectively on each baffle 17 serve to limit the angle formed between the baffles 17 and the side surfaces of fin 13 when baffles 17 are open or in the extended position, as shown in FIG. 2. A preferred angle is approximately 70°.

When the boat 10 is traveling forward under power it will normally not be desirable to have baffles 17 extend outwardly in the open position shown in FIG. 2. The flow of water past baffles 17 and fin 13 when the boat is moving forward will serve to hold baffles 17 in the closed position against the sides of fin 13. Baffle extensions 20 are provided on the outer ends of baffles 17 at an outward angle to aid in holding baffles 17 in the closed position against fin 13. Baffle extensions 20 catch the rearward flow of water from the forwardly moving boat and force the baffles against fin 13. When boat 10 is stopped or moving in a rearward direction, baffle extensions 20 aid in opening baffles 17 by catching the forward flow of water and opening baffles 17 to stabilize the boat.

Additional support is provided for the apparatus by a pair of cables 21 extending respectively from a pair of toggle clamps 22, 24 located on the hull deck on either side of bow 12 to an eyelet 23 positioned on shaft 14 near fin 13.

Figure 3:
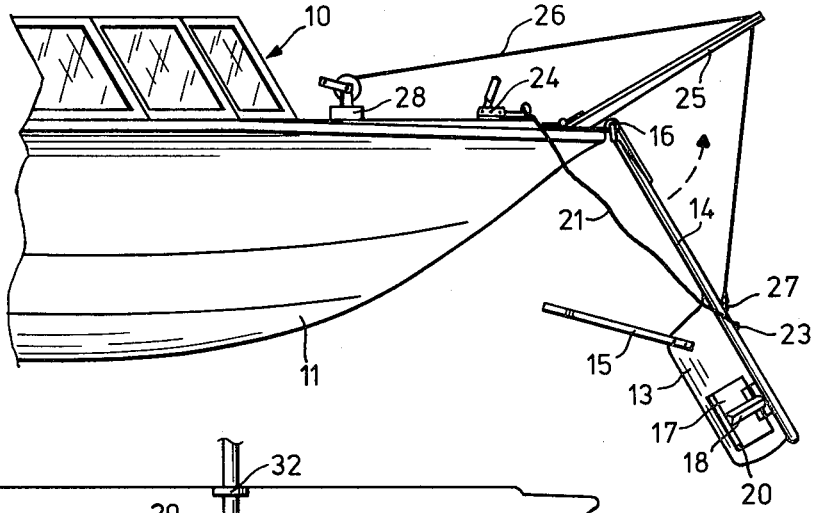

The apparatus can be raised from the operating position shown in FIG. 1 to the elevated position illustrated in FIG. 3 to transport the boat or proceed in shallow water. Lifting arm 25 attached to bow 12 at one end thereof is placed in the forward position shown in FIG. 3. A winchcable 26 extends over the other end of arm 25 from an eyelet 27 situated on shaft 14 to a winch 28 secured on the deck of hull 11. Winch 28 can be operated to raise and lower fin 13 and shaft 14. Hinge 16 at the upper end of shaft 14 preferably has a removable pin so that the entire apparatus can be removed from boat hull 11 for storage.

Figure 4:
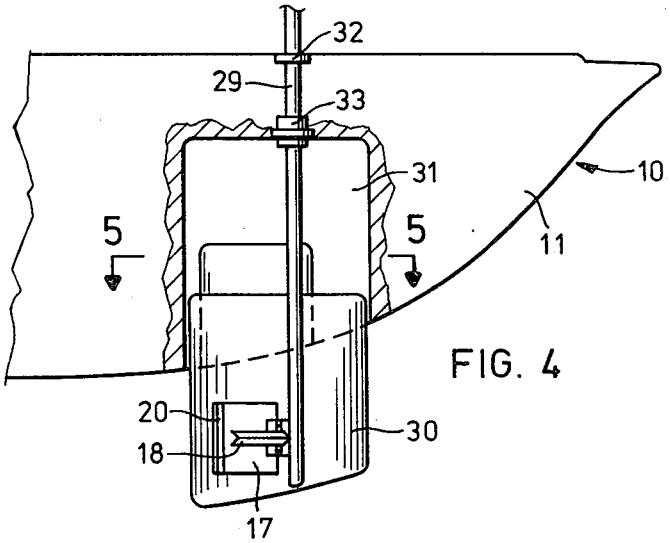
Figure 5:
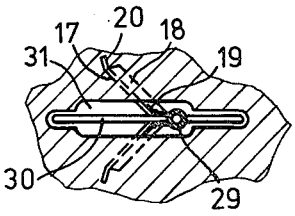

FIGS. 4 and 5 illustrate an alternate embodiment of the present invention wherein the stabilizer apparatus is installed internally of the hull 10 near the bow. An elongated shaft 29 extends through a stabilizer fin 30 and serves as the means to raise and lower fin 30 apparatus into a receptacle 31 situated in hull 11. The bottom of the stabilizer fin 30 is adapted to align with the curvature of the 11 when in the raised position. Shaft 29 is secured in hull 11 by an upper sleeve 32 attached to hull 11 and a lower bushing with a packing gland 33 attached to the upper surface of receptacle 31 and through which shaft 29 is axially slideable.

In use, the boat 10 is launched in the normal manner with the apparatus in the raised position shown in FIG. 3. Following launching, the apparatus is lowered to the position illustrated in FIG. 1. As boat 10 moves forward baffles 17 are forced by rearward water movement into a position parallel to stabilizer fin 13 for minimal resistance to the water. When boat 10 is exposed to lateral or forward water movement, flared baffle extensions 20 have a force exerted on them causing baffles 17 to open. This action causes the bow of the boat to move into the wind and remain there, thus keeping the waves from capsizing the boat.

There are many advantages to the apparatus of the present invention. In use, it exerts enough resistance to the motion of the water to effectively stop side roll of the boat. It also acts as a pivot for the boat, so that in setting a course, the apparatus will hold the boat to the desired course setting. The apparatus also acts as an effective sea anchor in a storm with loss of power, since the apparatus will force the boat around to put the bow into the wind and hold it there to reduce the chance of swamping the boat. The apparatus can also be used to troll and proceed at cross-angles to waves maintaining a relatively flat altitude to the surface.

While this invention has been described and illustrated herein with respect to preferred embodiments, it is understood that alternative embodiments and substantial equivalents may be included within the scope of the invention as defined by the appended claims.

I claim:

1. Boat stabilizer apparatus, comprising in combination:

an elongate shaft having means at one end thereof for connecting to the hull of a boat, so that said shaft extends downwardly below the boat hull;

stabilizer fin means having mutually opposing sides and being fixedly attached to said elongate shaft at the opposite end of said shaft;

a pair of baffle means each of which is hingedly attached at one edge thereof to a respective side of said stabilizer fin means;

a pair of vertical flange means each of which is attached to the outer vertical edge of a respective one of said pair of baffle means, said flange means being attached at such an angle to said baffle means that said flange means diverge outwardly from said stabilizer fin means, and hold said baffle means in a closed position relative to said stabilizer fin means when the boat is moving forward and hold said baffle means in an open position when the boat is moving rearwardly; and baffle stop means mounted respectively on said pair of baffle means for limiting the distance to which the baffle means can extend from said stabilizer fin means.

2. An apparatus as set forth in claim 1, wherein said elongate shaft has means for hingedly connecting the shaft to the bow of a boat hull, and also has means for raising and lowering said apparatus into and out of the water.

3. An apparatus as set forth in claim 1, wherein said apparatus is adapted for installation in a boat hull behind the bow and has means for raising and lowering said apparatus vertically into and out of a storage hold in the hull of a boat.

4. An apparatus as set forth in claim 1, wherein said stabilizer fin means has an elongate strut support means attached at one end thereof to said stabilizer fin means with the other end thereof being adapted for removeable disposition against the bow of the boat for support of said stabilizer fin means in a vertical position.

* * * * *